US006629695B2

(12) United States Patent
Tisdell

(10) Patent No.: US 6,629,695 B2
(45) Date of Patent: Oct. 7, 2003

(54) CALF ROPING TRAINING APPARATUS

(76) Inventor: James R. Tisdell, Rte. 4 #366, Hempstead, TX (US) 77445

( * ) Notice: Subject to any disclaimer, the term of this patent is extended or adjusted under 35 U.S.C. 154(b) by 111 days.

(21) Appl. No.: 09/916,150

(22) Filed: Jul. 27, 2001

(65) Prior Publication Data

US 2003/0034613 A1 Feb. 20, 2003

(51) Int. Cl.[7] ..... A63B 69/00; A01K 15/02
(52) U.S. Cl. ..... 273/359; 273/406; 119/839
(58) Field of Search ..... 273/359, 366–370, 273/406; 119/839

(56) References Cited

U.S. PATENT DOCUMENTS 3,324,832 A * 6/1967 McCain ..... 119/839
3,776,553 A * 12/1973 Kelton ..... 273/339
4,960,076 A * 10/1990 Snorgrass et al. ..... 119/839
5,255,629 A * 10/1993 Paterson ..... 119/839

* cited by examiner

*Primary Examiner*—Mark S. Graham
(74) *Attorney, Agent, or Firm*—Russell J. Egan

(57) ABSTRACT

A roping training apparatus provides a target moving along a substantially level track from a starting end to a stopping end. The target, such as a calf figure, is mounted on a wheeled platform and connected to one end of at least one tensioning member the other end of which is fixed to the stop end of the track. Guide means, such as cables, are connected between the ends of the track and engage and guide the target in its passage along the track. The actuating mechanism, in addition to the at least one tensioning member, includes latching assembly at the starting end of the track to engage the target assembly and hold it against the force of the at least one tensioning member. When the target is positioned in the actuating mechanism and then released, it moves along the track, under the influence of the at least one tension member, and a roper attempts to rope the target before it comes to a stop at the end of the track.

14 Claims, 3 Drawing Sheets

CALF ROPING TRAINING APPARATUS

BACKGROUND OF THE INVENTION

1. The Field of the Invention

The present invention relates to a device which may be used for improving the proficiency of a roper and/or for amusement purposes.

2. Description of the Prior Art

Calf roping is an art practiced in the cattle industry and in rodeos and requires training, timing, skill, and dexterity. Many roping training devices have been developed over the years with the purpose of improving the ski of ropers at ail levels. Also, various amusement devices have been developed to accommodate the spirit of competitive roping among both children and adults. In my prior art U.S. Pat. No. 3,406,969 issued Oct. 22, 1968 for "Roping Trailer Comprising a Roping Object Moveable Over a Pair of Parallel Spaced Tracks Forming a Closed Loop" a closed loop roping system is disclosed wherein a roper is mounted on a fixed horse shaped member and the roper attempts to rope a calf shaped target which moves along the closed loop. The calf shaped target is visible during only part of the closed loop cycle and then disappears from the view of the roper. The device disclosed in my prior patent, in which Monroe W. Lawson is listed as coinventor, is a relatively complex assembly which is cumbersome to move from one location to another.

It is therefore an object of the present invention to provide a roper training and amusement apparatus which is readily portable and economical to produce.

It is a further object of my invention to provide a roper training and amusement apparatus having a more varied action by the target thus providing an increased level of training for the roper, more excitement and interest in the activity.

The present invention relates to a device which is used to practice roping a target moving target along a substantially level pane. A moveable target, such as a calf figure, is mounted on a wheeled platform or truck. A track is provided with an actuating means including starting system at one end and stop means at the other end of the track. Guide means, such as cables, are connected between the ends of the track and engage and guide the target in its passage along the track. The actuating mechanism includes at least one tension member, such as a bungee cord, connected between the stop end of the track and the target and a starter system which engages the target holding it against the force of the at least one tension member. The actuating mechanism can also include a starting chute having two spring activated gates which allow the target to spring from the chute without damaging the target or marring its appearance. When the target is positioned in the actuating mechanism and the starter system actuated, the target is released and moves along the track under the influence of the at least one tension member, and a roper attempts to rope the target before it comes to a stop at the end of the track. The target is then moved back into the chute to repeat the event just described.

BRIEF DESCRIPTION OF THE DRAWINGS

The present invention will now be described, by way or example, with reference to the accompanying drawings, in which.

DETAILED DESCRIPTION OF THE INVENTION

Figure 1:
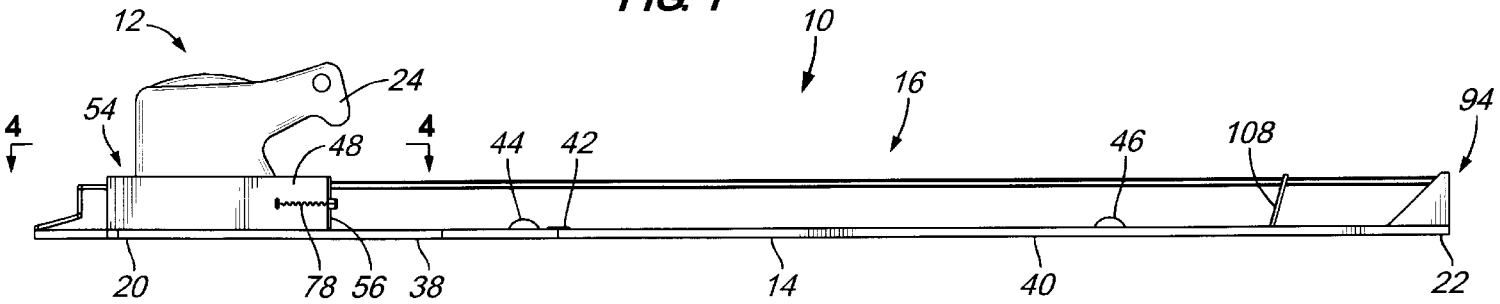
FIG. 1 is a side elevation of the roper training apparatus of the present invention in a starting position.
Figure 2:
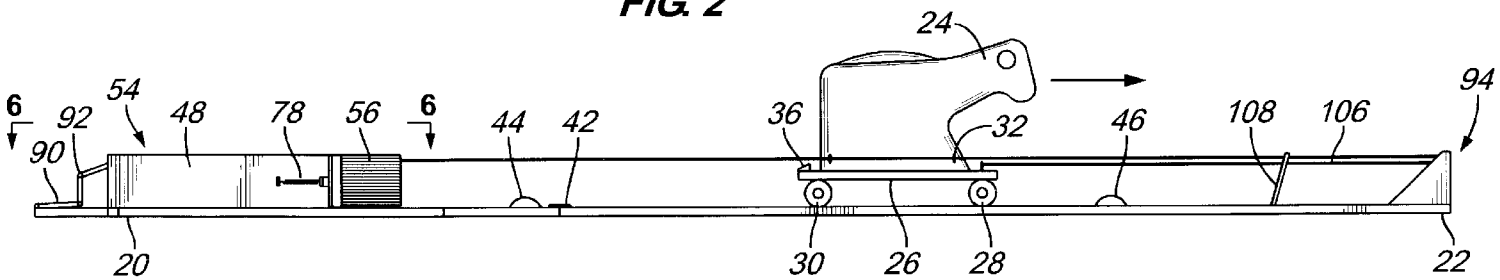
FIG. 2 is a side elevation of the roper training apparatus of the present invention in an operating position.
Figure 3:
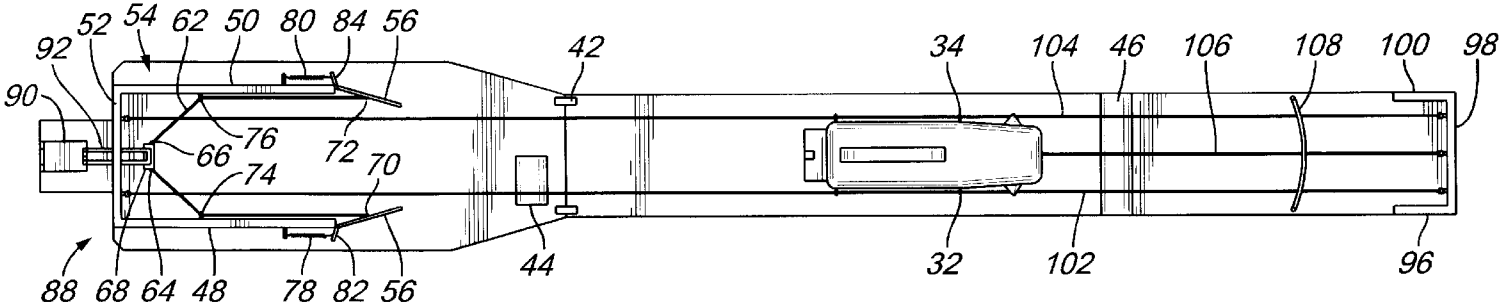
FIG. 3 is a top plan view of the roper training apparatus of the present invention in the operating position shown in FIG. 2.

FIG. 1 is a side elevation of the roper apparatus 10 of the present invention in a starting position. A target 12 is positioned on a track 14 with actuating means 16 propelling it from starter means 18 at a first end or starting end 20 of the track to second or stopping end 22 at the opposite end of the track 14.

The target 12 is shown here with a calf shaped FIG. 24 mounted on a movable platform or truck 26 provided with pairs of spaced apart front and rear wheels 28, 30, respectively, in conventional fashion. The target 12 is also provided with guide loops 32, 34 on both sides of the target and lug 36 and the rear end of platforms 26.

The track 14 is made of one or more sections 38, 40 of rigid material, such as plywood, with attachment means 42, for example hinges, securing the sections 38, 40, together to provide a long straight and level surface. The track 14 is also provided with contoured members 44, 46, which can either lie freely on the surface of the track or be temp orally fixed to the track by known clamping means (not shown). These contoured members 44, 46 serve to impart additional motion, i.e. rocking and/or jumping, to the target 12 as it progresses down the track 14. The track 14 may be provided with leveling means (not shown) to assure a fairly level surface along the entire length of the track. The track 14 may also be provided with fixed or detachable decorative side walls (also not shown), for safety and decorative purposes. The track further can be provided with markings (again not shown) for scoring or game purposes.

The actuating means 16 has a starter means 18 with side walls 48, 50, and end wall 52 forming a chute 54 opening down the track 14. Gate members 56, 58 are pivotally mounted on the open ends of side waits 48, 50 of chute 54. Preferably the gate members 56, 58 have inwardly directed brushes forming a flexible opening through which the target 12 passes without harm A pair of tension members 60, 62 are secured at their like first ends 64, 66 to block 68 and at their other ends 70, 72 to the gate members 56, 58, respectively. These tension members pass through guide means 74, 76 in the side walls 48, 50. Spring means 78, 80 are connected between side wails 48, 50 and lever means 82, 84 attached to gate members 56, 58, respectively. The block 68 is mounted on the free end of a flexible spring 86 and forms part of the trigger system 88. The trigger system 88 has a treadle or foot peddle 90 mounted on the end of track 14 and connected to linkage 92 which extends through the end wall 52 to engage the lug 36 on the platform 26.

A stop means 94 is mounted on the stop end of the track 14 and is formed by walls 96, 98, 100 forms an open enclosure preferably lined with resilient or cushioning material (not shown) to prevent damaging the platform and target. The stop means 94 can be detachable for ease of transport.

A pair of guide wires 102, 104 are fixed between the end wail 52 of the chute and the end wail 98 of the stop means 94. These guide wires 102, 104 pass through the guide loops 32, 34 on the target 12. A flexible stop 108 can be mounted over these guide wires.

The actuating means includes at least one tensioning member 106 which may, for example be a bungee cord, spring, or rope and spring combination. T his tensioning member provides the energy for propelling the target 12 down the track 14. Thus by appropriate selection of the tensioning member 106 the speed of the target can be controlled to a certain degree.

Figure 4:
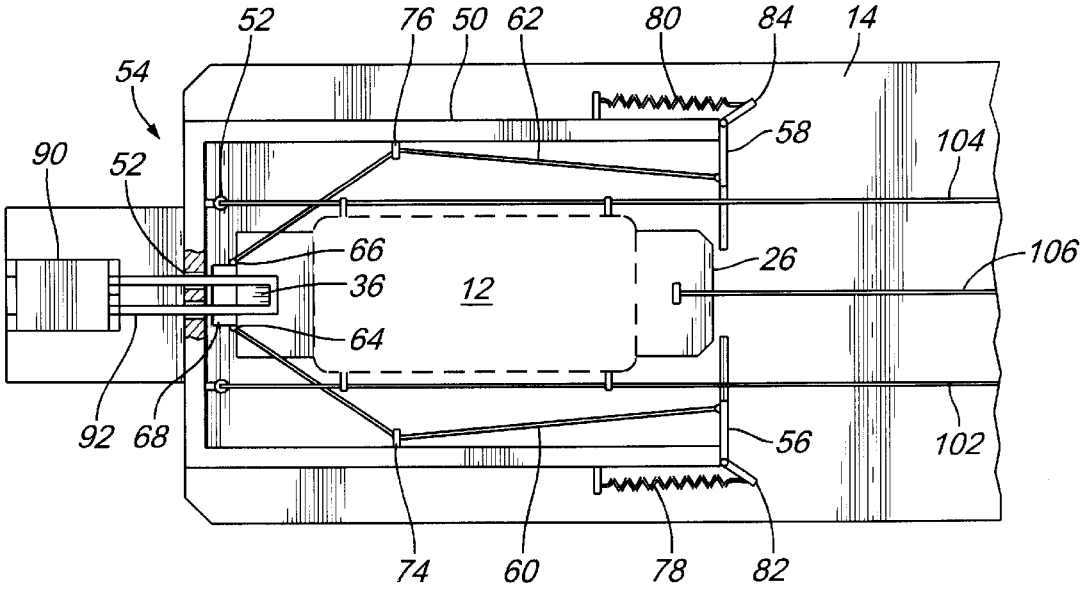
FIG. 4 is an enlarged top plan view, taken along line 4—4 of FIG. 1, of the starter system of the subject roper training apparatus in a ready condition.
Figure 5:
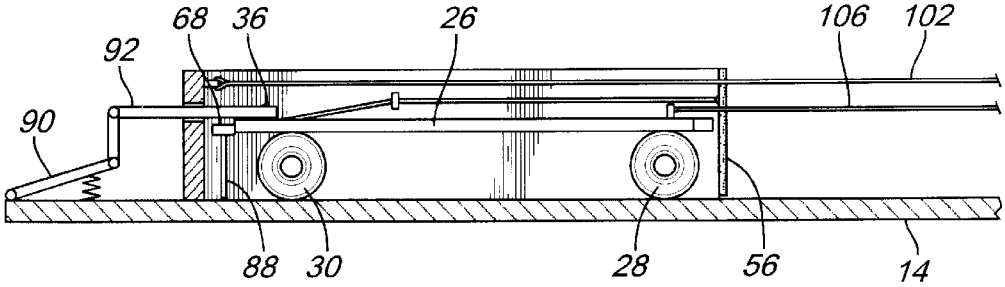
FIG. 5 is an enlarged side elevation, partially in section, of the starter system of the subject roper training apparatus in the ready condition of FIG. 4.
Figure 6:
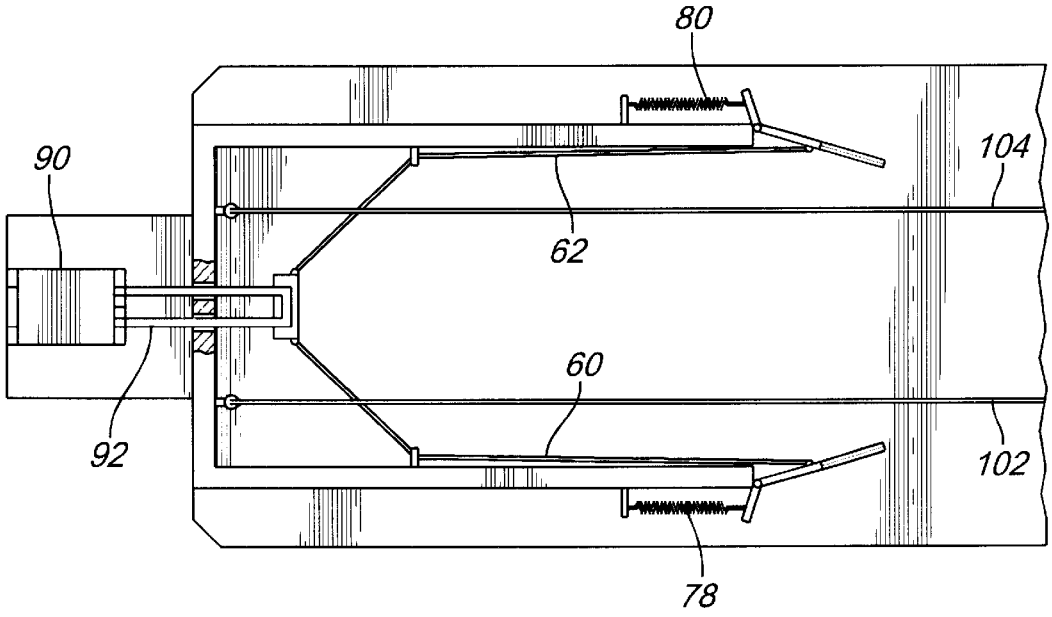
FIG. 6 is an enlarged top plain view, taken along line 6—6 of FIG. 2, of the starter system of the subject roper training apparatus in an open condition.
Figure 7:
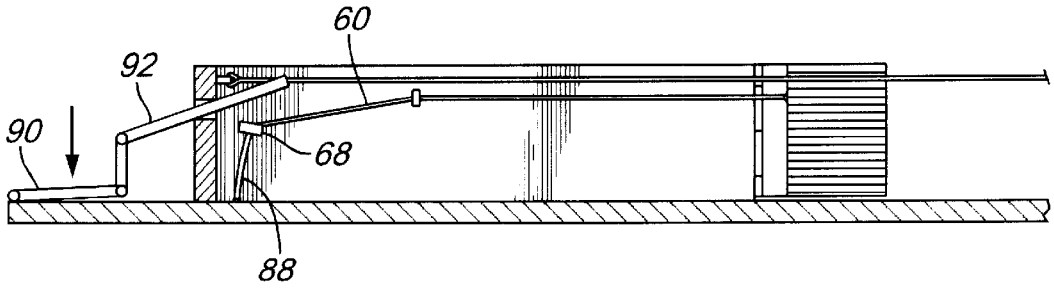
FIG. 7 is an enlarged side elevation, partially in section, of the starter system of the subject roper training apparatus in the open position of Gig 6.

The device is operated by drawing the target 12 into the 54 until the lug 36 is engaged by the linkage 92, as shown in FIGS. 1, 4 and 5. At this point in time, the platform 26 is under tension of the member 106 and members 60, 62, which also hold the gate members 56, 58 in their closed position. The lug 36 is held by the linkage as shown in FIGS. 4 and 5. Upon depressing the treadle 90, the linkage 92 releases the lug 36 allowing the tensioning members 60, 62, 106 to take over. The gates 56, 58 open to the pull of spring members 78, 80 and the tensioning member 106 draws the target 12 down the track 14. If the contour members 44, 46 are in place along the track 14, they will impart addition movement to the target 12 as it moves along the track 14.

It will be appreciated that as the calf target 12 moves along track 14 that a roper having a rope (neither of which is shown) can attempt to rope the calf target 12 prior to the time that it reaches the stop 94. If the apparatus of the present invention is used for amusement purposes, points may be scored for each time a selected roper ropes the calf target 12 thereby allowing competition among various individual ropers so that the individual roper having the most points wins the roping contest. It is also within the purview of the present invention to nave the tensioning means 106 be of different numbers and/or strengths to provide for a range of speeds for the target calf 12 to move, thereby making roping more difficult.

While the target 12 has been shown and described as being a calf figure, it is within the scope of the present invention to have the head of the figure mounted on the body by articulated means allowing for movement of the head with respect to the body as the target moves along the track to increase the difficulty in roping the target. Such head movement could also be associated with controls not shown) responsive to wheel movement. Further, the calf figure of the target could be replaced by any other suitable figure, such as an alien or cartoon character, to provide interest and excitement to a different, possibly younger, set of fans. To this end the chute 54 may be replaced by a more suitable structure, such as a hanger, grotto, etc. Further, the trigger assembly can be hidden from the roper's view by a screen (not shown) possibly with a one way mirror opening allowing the starter to view the roper and elevate the element of surprise of the target bolting from the chute.

There are many variations of the games which can be played with the subject invention. For example, the track can be marked, or possibly the surface thereof colored, to indicated zones where the target may be roped or points for speed in roping.

Thus it will be appreciated that the roper apparatus of the present invention provides simplicity, economy and reliability as well as improved proficiency through a combination of elements acting in a new and useful manner to achieve a result not available prior to the present invention.

The present invention may be subject to many modifications and changes without departing from the spirit or essential characteristics thereof. The above described embodiment should therefor be considered in all respects as illustrative and not restrictive of the scope of the present invention as defined by the appended claims.

I claim:

1. A roper training apparatus comprising:

an elongated track formed by at least one rigid member having a starting end and a stop end;

a target assembly mounted for movement along said track; and actuation means for moving said target along said track, said actuation means comprising:

at least one tension member having a first end fixed to said stop end of said track and its second end fixed to said target assembly;

a trigger assembly mounted at said start end of said track and having latch means to engage said target assembly to hold it against the pull of said at least one tension member; and means to release said latch means freeing said target assembly for movement down said track under the influence of said at least one tension member.

2. The roper training apparatus according to claim 1 wherein said stop end has means to stop the forward motion of said target assembly without damage.

3. The roper training apparatus according to claim 1 wherein said elongated track comprises:

at least two elongated rigid members and means to at least temporarily secure said at least two members together to form a continuous level surface.

4. The roper training apparatus according to claim 1 wherein said elongated track further comprises:

at least one member received on said track to provide a jumping and/or sidewise movement to said target assembly.

5. The roper training apparatus according to claim 1 wherein said target assembly comprises:

a generally rectangular platform having wheels along both elongated sides, a target figure fixed to and extending upwardly from the platform, and guide engaging means.

6. The roper training apparatus according to claim 5 wherein said target figure of said target assembly comprises:

a substantially rigid figure of a calf.

7. The roper training apparatus according to claim 6 wherein said figure of a calf has an articulated head whereby a more lifelike action is provided.

8. An entertainment apparatus comprising:

an elongated track having a first starting end and a remote second stopping end;

a target assembly having a wheeled truck carrying a target figure;

an actuation means having at least one tensioning member connected between said target assembly and said stopping end of said track, and trigger means at the starting end of said track to latch onto said target assembly and hold it against the force or said at least one tensioning member, whereby tripping of said trigger means releases said target assembly to move the length of said track under the influence of said at least one tensioning member.

9. An entertainment apparatus according to claim 8 wherein said elongated track comprises:

at least two rigid members having a starting end and a stop end with means to stop the forward motion of said target assembly without damage; and means securing said track members together to form a substantially level surface.

10. The entertainment apparatus according to claim 8 wherein said stop end has means to stop the forward motion of said target assembly without damage.

11. The entertainment apparatus according to claim 8 further comprising:

at least one member received on said track to provide a jumping and/or sidewise movement to said target assembly as it moves along said track.

12. The entertainment apparatus according to claim 8 wherein further comprising:

guide means extending the length of said track; and means on said target assembly engaging said guide means whereby said target assembly safely traverses the entire track.

13. The entertainment apparatus according to claim 8 wherein said target figure of said target assembly comprises:

an animal at least a portion of which is articulated to give additional life like movement to the figure as it traverses said track.

14. The entertainment apparatus according to claim 8 wherein said actuation means comprises:

at least one tension member having a first end fixed to said stop end of said track and its second end fixed to said target assembly;

a trigger assembly mounted at said start end of said track and having latch means to engage said target assembly to hold it against the pull of said at least one tension member, and means to release said latch means freeing said target assembly for movement down said track under the influence of said at least one tension member, the combined tension of which control the speed of movement of said target assembly.

* * * * *